US006615541B2

(12) United States Patent
Weder

(10) Patent No.: US 6,615,541 B2
(45) **Date of Patent: *Sep. 9, 2003**

(54) SHEETS OF MATERIAL HAVING FORMING INDICIA FOR FORMING INTO FLOWER POTS OR PLANT COVERS AND METHODS

(75) Inventor: Donald E. Weder, Highland, IL (US)

(73) Assignee: Southpac Trust International, Inc., Rarotonga (CK)

( * ) Notice: Subject to any disclaimer, the term of this patent is extended or adjusted under 35 U.S.C. 154(b) by 0 days.

This patent is subject to a terminal disclaimer.

(21) Appl. No.: 10/213,731

(22) Filed: Aug. 6, 2002

(65) Prior Publication Data

US 2003/0029084 A1 Feb. 13, 2003

Related U.S. Application Data

(63) Continuation of application No. 09/632,477, filed on Aug. 4, 2000, now Pat. No. 6,484,442, which is a continuation-in-part of application No. 09/459,811, filed on Dec. 13, 1999, now abandoned, which is a continuation of application No. 09/041,409, filed on Mar. 12, 1998, now abandoned.

(51) Int. Cl.[7] ..... A01G 9/02
(52) U.S. Cl. ..... 47/72
(58) Field of Search ..... 47/72

(56) References Cited

U.S. PATENT DOCUMENTS

| | | | |
|---|---|---|---|
| 170,991 | A | 12/1875 | Conover |
| 797,175 | A | 5/1905 | Collenburg et al. |
| 991,246 | A | 5/1911 | Rosenfeld |
| 1,002,346 | A | 9/1911 | Weeks |
| 1,006,722 | A | 10/1911 | Claussen et al. |
| 1,065,486 | A | 6/1913 | Washburn |
| 1,069,675 | A | 8/1913 | Claussen |
| 1,117,848 | A | 11/1914 | House |
| 1,124,618 | A | 1/1915 | House |
| 1,184,956 | A | 5/1916 | Hoppke |
| 1,293,316 | A | 2/1919 | Bogert |
| 1,446,014 | A | 2/1923 | Lodge |
| 1,464,534 | A | 8/1923 | Lovett, Jr. |
| 1,520,647 | A | 12/1924 | Hennegan |
| 1,645,931 | A | 10/1927 | Ruckert et al. |
| 1,697,751 | A | 1/1929 | Blake |
| 1,714,293 | A | 5/1929 | Batdorf |
| 1,716,554 | A | 6/1929 | Hoff, Jr. |
| 1,868,853 | A | 7/1932 | Sievers |
| 1,918,811 | A | 7/1933 | Huff |
| 2,016,434 | A | 10/1935 | Huntley |
| 2,054,934 | A | 9/1936 | Graffenberger |
| 2,171,835 | A | 9/1939 | Mackie |
| 2,206,406 | A | 7/1940 | Kock |
| 2,260,230 | A | 10/1941 | Olson |
| 2,302,259 | A | 11/1942 | Rothfuss |
| 2,355,559 | A | 8/1944 | Renner |
| 2,367,749 | A | 1/1945 | Barbieri |

(List continued on next page.)

FOREIGN PATENT DOCUMENTS

| | | |
|---|---|---|
| FR | 2406522 | 5/1979 |

OTHER PUBLICATIONS

"A World Of Cut Flower And Pot Plant Packaging" published by Klerk's Plastic Products Manufacturing, Inc., 6 pages, date unknown.

*Primary Examiner*—Peter M. Poon
*Assistant Examiner*—Francis T. Palo
(74) *Attorney, Agent, or Firm*—Dunlap, Codding & Rodgers, P.C.

(57) ABSTRACT

A decorative cover formed from a sheet of material having forming indicia thereon is disclosed. The forming indicia permits an operator to form the sheet of material into the decorative cover without the use of a mold, such as a flower pot or potted plant. A method for forming the sheet of material into the decorative cover is also disclosed.

24 Claims, 5 Drawing Sheets

U.S. PATENT DOCUMENTS

| | | | | |
|---|---|---|---|---|
| 2,459,073 | A | | 1/1949 | Hamilton |
| 2,468,306 | A | | 4/1949 | Norden |
| 2,529,060 | A | | 11/1950 | Trillich |
| 2,540,707 | A | | 2/1951 | Beukelman |
| 2,586,078 | A | | 2/1952 | O'Malley |
| 2,676,897 | A | | 4/1954 | Trillich |
| 2,800,945 | A | | 7/1957 | Schilling |
| 2,808,192 | A | | 10/1957 | Raisin |
| 2,827,217 | A | | 3/1958 | Clement |
| 2,967,652 | A | | 1/1961 | Canfield et al. |
| 3,423,008 | A | | 1/1969 | Mykleby |
| 3,681,105 | A | | 8/1972 | Milutin et al. |
| 4,043,977 | A | | 8/1977 | deMontigrey et al. |
| 4,170,618 | A | | 10/1979 | Adams |
| D254,659 | S | | 4/1980 | Karotseris |
| 4,773,182 | A | | 9/1988 | Weder et al. |
| 5,076,011 | A | | 12/1991 | Stehouwer |
| 5,111,638 | A | | 5/1992 | Weder |
| 5,117,584 | A | | 6/1992 | Ottenwalder et al. |
| 5,328,265 | A | | 7/1994 | Clooney |
| 5,332,610 | A | | 7/1994 | Weder et al. |
| 5,402,601 | A | | 4/1995 | Garcia |
| 5,489,453 | A | | 2/1996 | Friesch |
| 5,832,663 | A | | 11/1998 | Weder et al. |
| 6,089,446 | A | | 7/2000 | Hirano |
| 6,484,442 | B1 | * | 11/2002 | Weder ..... 47/72 |

* cited by examiner

SHEETS OF MATERIAL HAVING FORMING INDICIA FOR FORMING INTO FLOWER POTS OR PLANT COVERS AND METHODS

CROSS-REFERENCE TO RELATED APPLICATIONS

This application is a continuation of U.S. Ser. No. 09/632,477, filed Aug. 4, 2000, now U.S. Pat. No. 6,484,442 entitled "SHEETS OF MATERIAL HAVING FORMING INDICIA FOR FORMING INTO FLOWER POTS OR PLANT COVERS AND METHODS "; which is a continuation-in-part of U.S. Ser. No. 09/459,811 entitled "SHEETS OF MATERIAL HAVING FORMING INDICIA FOR FORMING INTO FLOWER POTS OR PLANT COVERS AND METHODS", filed Dec. 13, 1999, now abandoned; which is a continuation of U.S. Ser. No. 09/041,409 entitled "SHEETS OF MATERIAL HAVING FORMING INDICIA FOR FORMING INTO FLOWER POTS OR PLANT COVERS AND METHODS", filed Mar. 12, 1998, now abandoned.

STATEMENT REGARDING FEDERALLY SPONSORED RESEARCH OF DEVELOPMENT

Not applicable.

BACKGROUND OF THE INVENTION

1. Field of the Invention

This invention relates to sheets of material having indicia thereon which provide guidance to an operator for forming a sheet of material into a decorative cover, and methods of performing same.

2. Brief Description of the Prior Art

Sheets of material have been formed into decorative covers for various items. When the decorative cover is formed by a user, the material from which the decorative cover is constructed is frequently shape-sustaining. Such materials would include foils with dead fold characteristics.

Other sheets of material having non-shape-sustaining characteristics have been formed into shape-sustaining decorative covers; however, formation of a non-shape sustaining sheet of material into a shape-sustaining decorative cover requires either the use of a mold to form the material the decorative cover or a band or bonding material to secure the formed cover about an object. A mechanical process which uses a mold to form a non-shape sustaining sheet of material into a substantially shape-sustaining decorative cover is disclosed in U.S. Pat. No. 4,773,182, entitled "Article Forming System", issued to Weder et al on Sep. 27, 1988. Another example of the use of a mold to form a non-shape sustaining material into a shape-sustaining decorative cover is disclosed in U.S. Pat. No. 2,355,559 entitled "Cover For Containers", issued to Renner on Nov. 6, 1940.

Therefore, there is a need felt within the art for a shape-sustaining decorative container which may be formed from a non-shape sustaining sheet of material without the use of a mold to assist in the formation thereof, and which do not require a band or a bonding material to hold the decorative cover about an object.

SUMMARY OF THE INVENTION

The present invention provides a sheet of material having forming indicia and bonding material thereon for enhancing formation of the sheet of material into a decorative cover, as well as methods for forming such sheet of material into the decorative cover. Broadly, the sheet of material is formed into the decorative cover by gathering together at least a portion of the sheet of material designated by the forming indicia which are bonded by the bonding material to provide a shape-sustaining decorative cover having a plurality of gathered portions. The decorative cover when formed is substantially both self-supporting and shape sustaining.

An objective of this invention is to provide a quick and easy way to form a decorative cover from a sheet of material without the use of a mold or the need to form the decorative cover about a flower pot.

Another object of the present invention, while achieving the above stated object, is to provide a decorative cover which, once formed, can be substantially flattened and unflattened for storage and/or shipping and which is provided with a substantially continuous pattern, with little or no disruption in the majority of the pattern of the decorative cover due to numerous and irregular creases and folds.

Other objects, features and advantages of the present invention will become apparent from the following detailed description when read in conjunction with the accompanying drawings.

DETAILED DESCRIPTION OF THE INVENTION

Description of FIGS. 1–5

Figure 1:
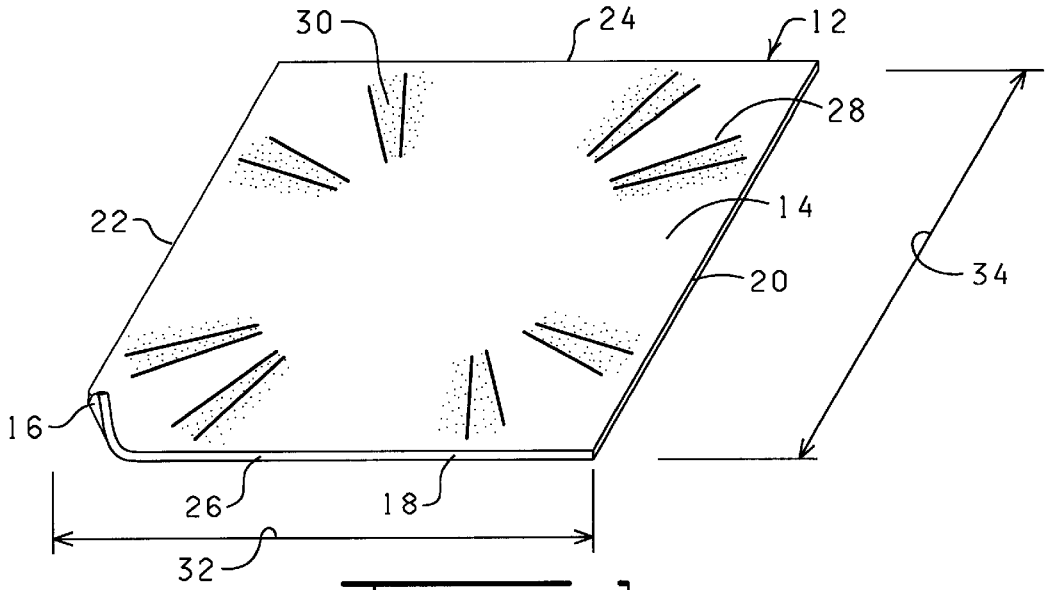
FIG. 1 is a perspective view of a sheet of material constructed in accordance with the present invention, the sheet of material having forming indicia thereon and having one corner turned up for illustration purposes only.

Referring now to FIG. 1, designated therein by the general reference numeral 12 is a sheet of material for forming a decorative cover. The sheet of material 12 has an upper surface 14, a lower surface 16, an outer periphery 18, a first side 20, a second side 22, a third side 24 and a fourth side 26. The sheet of material 12 is substantially flat.

The sheet of material 12 is further provided with forming indicia 28 thereon which direct an operator in the formation of the sheet of material 12 into a decorative cover, as will be discussed in detail hereinafter. The term "forming indicia" as used herein will be understood to include score lines, and/or other printed indicia including printed instructions, letters, numbers or drawings, unprinted indicia such as embossing, creases and other textures, or any combination thereof. The forming indicia 28 may be in the form of a pattern, or, in the alternative, the forming indicia 28 may constitute a lack of a pattern on the sheet of material 12 having a pattern in other locations.

Located at or adjacent the forming indicia 28 on the sheet of material 12 is a bonding material 30. The term "bonding material" as used herein will be understood to include an adhesive, such as a pressure sensitive adhesive, or a cohesive. Where the bonding material 30 is a cohesive, a similar cohesive bonding material 30 must be placed on the adjacent surface of the sheet of material 12 for bondingly contacting and bondingly engaging with the bonding material 30.

The term "bonding material" as used herein also includes materials which are heat sealable and, in this instance, adjacent portions of the sheet of material 12 must be brought into contact and then heat must be applied to effect the seal. The term "bonding material" also includes materials which are sonically sealable and sealable by vibration. The term "bonding material" when used herein also includes a lacquer, such as a sealing lacquer, which may be applied to the sheet of material 12 and, in this instance, heat, sound waves, or vibrations also must be applied to effect and create the sealing.

The term "bonding material" when used herein also includes any type of material or thing which can be used to effect the bonding or connecting of the two adjacent portions of the sheet of material 12 to effect the connection or bonding described herein.

Figure 2:
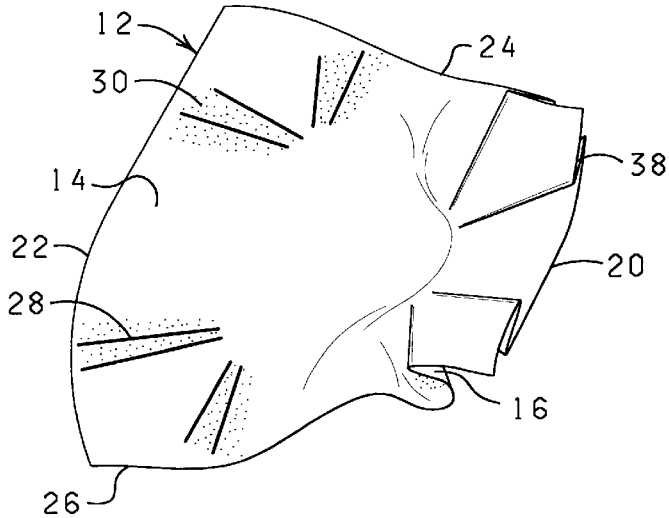
FIG. 2 is a perspective view of the sheet of material of FIG. 1 being partially formed into a portion of a decorative cover.

The bonding material 30 utilized in the present invention is depicted in FIGS. 1 and 2 as being disposed on the upper surface 14 of the sheet of material 12. However, it will be understood that the bonding material 30 may be disposed on the lower surface 16 of the sheet of material 12 or on both the upper and lower surfaces 14 and 16 of the sheet of material 12. The bonding material 30 is disposed on the sheet of material 12 by any method of disposing a bonding material 30 on a sheet of material 12 known in the art, such as painting the bonding material 30 on the sheet of material 12, spraying the bonding material 30 on the sheet of material 12, or immersing the sheet of material 12 in the bonding material 30. These methods of disposing a bonding material on a sheet of material are well known in the art and commercially available.

The bonding material 30 is often disposed on the surface of the sheet of material 12 which has the forming indicia 28 thereon, in this instance the upper surface 14 of the sheet of material 12. As shown in FIG. 1, the bonding material 30 is disposed on the upper surface 14 as a plurality of strips of bonding material 30. It will be understood, however, that the bonding material 30 could also be applied to the upper surface 14 of the sheet of material 12 and/or the lower surface 16 of the sheet of material 12 in the form of spaced apart spots or in any pattern, shape, or groups of patterns or shapes, or in any other geometric or non-geometric form. Alternatively, the bonding material 30 may be applied to an entire surface of the sheet of material 12.

The sheet of material 12 has a length 32 extending between the first and the second sides 20 and 22, respectively, of the sheet of material 12. The sheet of material 12 also has a width 34 extending between the third and fourth sides 24 and 26, respectively, of the sheet of material 12.

The sheet of material 12 may be any shape, and a square shape is shown in FIG. 1 only by way of example. The sheet of material 12 may be rectangular, circular, any geometric or non-geometric shape, or any combination of geometric, non-geometric and/or asymmetric shapes.

Any thickness of the sheet of material 12 may be utilized in accordance with the present invention as long as the sheet of material 12 is wrappable about an object, such as a flower pot or a plant contained in a growing medium, as described herein, and as long as the sheet of material 12 provides the rigidity described herein to form a decorative cover. Preferably, the sheet of material 12 has a thickness in a range of from about 0.1 mil to about 30 mil. The sheet of material 12 may be constructed of a single layer of material or a plurality of layers of the same or different types of materials. When the sheet of material 12 is constructed of a plurality of layers of material, the layers of material comprising the sheet of material 12 may be connected together such as by lamination or may be separate layers. For example, the sheet of material 12 may be constructed from two polypropylene films (a 20"×15" sheet of Mobil 270 ABW white opaque film laminated to a 20"×15" sheet of Mobil 220 AB clear film) having a thickness in a range of from less than about 1.0 mil to about 2.5 mil.

It will be understood, however, that the sheet of material 12 can be constructed from any suitable material that is capable of being wrapped about a flower pot and/or a plant in growing media. Preferably, the sheet of material 12 is selected from the group consisting of paper (untreated or treated in any manner), foil, polymeric film, fabric (woven, nonwoven, synthetic or natural), burlap, and combinations or laminates thereof.

The term "polymeric film" as used herein includes a synthetic polymer such as polypropylene, polyethylene or polyvinyl chloride, or a naturally occurring polymer such as cellophane. A polymeric film is relatively strong and not as subject to tearing (substantially non-tearable), as might be the case with paper or foil.

The sheet of material 12 may vary in color. Further, the sheet of material 12 may consist of designs or decorative patterns which are printed, etched, and/or embossed thereon using inks or other printing materials. An example of an ink which may be applied to the surface of the sheet of material 12 is described in U.S. Pat. No. 5,147,706 entitled "Water Based Ink On Foil And/Or Synthetic Organic Polymer" issued to Kingman on Sep. 15, 1992 and which is expressly incorporated herein by reference. In addition, the sheet of material 12 may have various colorings, coatings, flocking and/or metallic finishes, holographic images, or other decorative surface ornamentation applied separately or simultaneously thereto. Further, the sheet of material 12 may be characterized totally or partially by pearlescent, neon, translucent, transparent, opaque, partially clear or iridescent qualities. Each of the above-named characteristics may occur alone or in combination and may be applied to the upper surface 14 and/or lower surface 16 of the sheet of material 12. Moreover, each surface of the sheet of material 12 may vary in the combination of such characteristics.

Figure 3:
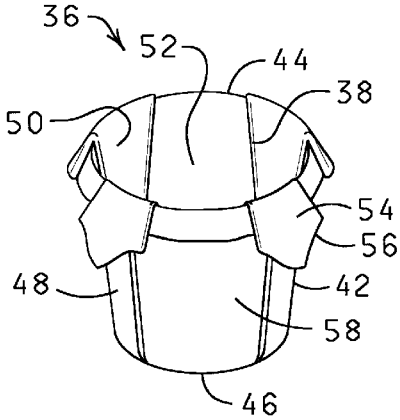
FIG. 3 is a perspective view of a decorative cover formed from the sheet of material of FIG. 1, the decorative cover having a plurality of pleats.

FIGS. 1–3 show a schematic representation of one method of forming the sheet of material 12 of the present invention into a decorative cover 36 utilizing the forming indicia 28. It will be recognized that forming patterns, including pleats, flaps, fins, gathers, crimping, and any combination thereof may be formed in the completed decorative cover 36 utilizing the forming indicia 28 on the sheet of material 12. In this instance, the forming indicia 28 includes a plurality of lines or creases which are utilized to form, in this instance, pleats in the sheet of material 12. The bonding material 30 is disposed on and/or adjacent the forming indicia 28. When the sheet of material 12 is folded in accordance with the forming indicia 28, the bonding material 30 holds the pleats or folds in place, so that the sheet of material 12 forms the decorative cover 36.

It will be appreciated that the decorative cover 36 will be created by folding, gathering and/or crimping the sheet of material 12 as designated by the forming indicia 28. The term "gather", "gathered", and/or "gathering" as used herein includes folding, pleating and/or crimping the sheet of material 12. That is, the decorative cover 36 may be formed from the sheet of material 12 without a flower pot or other mold or any form, including a plant in a growing medium, being utilized to assist in forming the sheet of material 12 into the decorative cover 36 which would be capable of retaining a flower pot. However, it will be understood that a flower pot or mold may be used with the folding process, if desired.

In this instance, the forming indicia 28 directs the operator to provide a plurality of pleats 38 at predetermined portions on the sheet of material 12. It will be appreciated that the pleats 38 may be formed on the sheet of material 12 such that each pleat 38 is on an inner peripheral surface 50 (FIG. 3) of the decorative cover 36. Alternatively, the pleats (not shown) may be formed on an outer peripheral surface 48 (FIG. 3) of the decorative cover 36.

FIG. 2 shows the method of forming the sheet of material 12 into the decorative cover 36 without the use of a flower pot or a mold. The sheet of material 12 is formed into the decorative cover 36 by gathering together at least a portion of the sheet of material 12 designated by the forming indicia 28, thereby forming one or more pleats 38 in the sheet of material 12. The pleats 38 are held together via the bonding material 30 disposed on the sheet of material 12 on and/or adjacent the forming indicia 28. This process is repeated until pleats 38 have been formed in all portions of the sheet of material 12 having forming indicia 28 thereon.

In this instance, the decorative cover 36 of FIG. 3 has a frusto-conical shape. It will be appreciated, however, that the decorative cover 36 could be cylindrical or other geometric, non-geometric shapes and/or asymmetric shapes.

The decorative cover 36, when formed, comprises a base 42 having an open upper end 44, a lower end 46, an outer peripheral surface 48, an inner peripheral surface 50, and a retaining space 52. The retaining space 52 is sized to hold a flower pot or a plant in a growing medium. The decorative cover 36 may also have a skirt 54 which extends from the open upper end 44. The skirt 54 has an outer edge 56 which may have a decorative design, such as a scalloped design, a serrated design, an undulating design, and combinations thereof. In the alternative, it will be understood that the decorative cover 36 may be formed with a base 42 but without a skirt 54. In this instance, the base 42 may terminate at the open upper end 44 thereof, the open upper end 44 having an edge which may be straight or may have a design, such as a scalloped design, a serrated design, an undulating (sinusoidal) design, and combinations thereof. The configuration of the outer edge 56 of the skirt 54 of the decorative cover 36 (or the outer edge of the open upper end 44 of the base 42 if the decorative cover 36 is not provided with a skirt 54) will depend on the configuration of the outer periphery 18 of the sheet of material 12.

The outer peripheral surface 48 of the base 42 of the decorative cover 36 is provided with a plurality of panels 58 which extend from the open upper end 44 of the base 42 of the decorative cover 36 to the lower end 46 of the base 42 of the decorative cover 36. A decorative pattern may be provided on the lower surface 16 of the sheet of material 12, and such pattern may be displayed on the panels 58 of the outer peripheral surface 48 of the base 42 of the decorative cover 36 with little or no distortion thereto.

Figure 4:
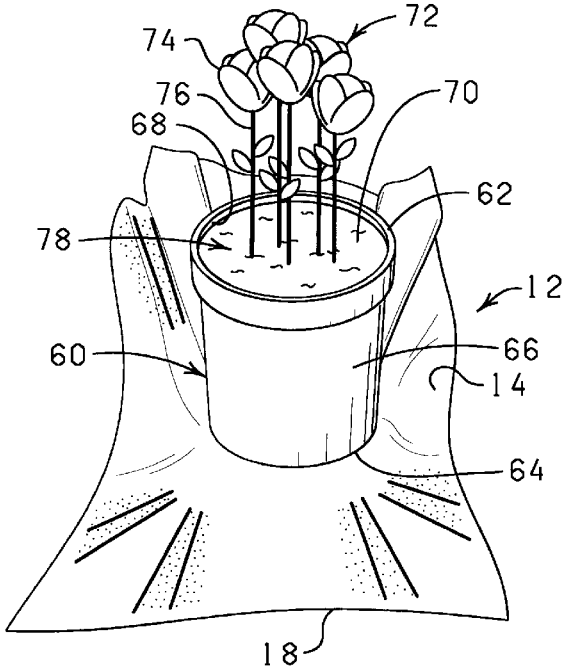
FIG. 4 is a perspective view of the sheet of material of FIG. 1 being partially formed into a decorative cover about a flower pot having a floral grouping disposed therein.

While a flower pot is not required for use as a mold in formation of the decorative cover 36, a flower pot may be disposed on the sheet of material 12 at any time during the formation of the decorative cover 36. FIG. 4 depicts a flower pot 60 disposed on the sheet of material 12 while the sheet of material 12 is being formed, as described above, into the decorative cover 36. The flower pot 60 has an open upper end 62, a lower end 64, an outer peripheral surface 66 and an inner peripheral surface 68 defining a retaining space 70 sized to receive a floral grouping 72 comprises a bloom portion 74 and a stem portion 76 and growing medium 78. When the decorative cover 36 is formed, the flower pot 60 is disposed in the retaining space 52 of the base 42 of the decorative cover 36, the outer peripheral surface 66 of the flower pot 60 being adjacent and substantially surrounded and encompassed by the inner peripheral surface 50 of the decorative cover 36. The flower pot 60 having the floral grouping 72 and/or the growing medium 78 disposed therein may herein be referred to as a "potted plant".

The term "pot" or "flower pot" as used herein refers to any type of container used for holding a floral grouping or a potted plant. Examples of flower pots used in accordance with the present invention are clay pots, plastic pots, pots made from glass, pots made from metal, or pots made from other materials, such as styrofoam, natural fibers and/or synthetic fibers, and combinations thereof.

The term "plant" when used herein refers to a natural or artificial herbaceous or woody plant, taken singly or in combination. The term "plant" also refers to any portion or portions of natural or artificial herbaceous or woody plants including stems, leaves, flowers, blossoms, buds, blooms, cones, or roots, taken singly or in combination, or in groupings of such portions such as a bouquet or a floral grouping.

The term "growing media" and/or "growing medium" as used herein refers to any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "floral grouping" as used herein refers to cut fresh flowers, artificial flowers, a single flower, fresh and/or artificial plants, other floral materials, or combinations thereof, and may include secondary plants and/or ornamentation or artificial or natural materials which add to the aesthetics of the overall floral arrangement. The floral grouping comprises a bloom or foliage portion and a stem portion, and, on occasion, a root portion. However, it will be appreciated that the floral grouping may consist of only a single bloom or only foliage. The term "floral grouping" may be used interchangeably herein with the term "floral arrangement".

Figure 5:
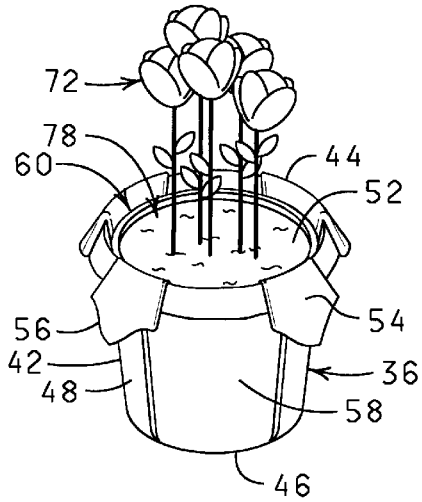
FIG. 5 is a perspective view of the sheet of material of FIG. 4 formed into a decorative cover about the flower pot containing the floral grouping.

Whether the flower pot 60 containing the floral grouping 72 is disposed on the sheet of material 12 before, during or after the formation of the sheet of material 12 into the decorative cover 36, the outer peripheral surface 66 of the flowerpot 60 will be substantially surrounded and encompassed by the decorative cover 36, as shown in FIG. 5.

The growing medium 78 containing the floral grouping 72 may be disposed in the flower pot 60 prior to disposal of the flower pot 60 in the decorative cover 36, or the flower pot 60 alone may be disposed in the decorative cover 36. Alternatively, the growing medium 78 containing the floral grouping 72 may be disposed directly into the decorative cover 36. That is, the growing medium 78 may be disposed in the retaining space 52 of the base 42 of the decorative cover 36 such that the growing medium 78 is adjacent the inner peripheral surface 50 of the base 42 of the decorative cover 36. The growing medium 78 will then be substantially surrounded and encompassed by the base 42 of the decorative cover 36.

Description of FIGS. 6–12

Figure 6:
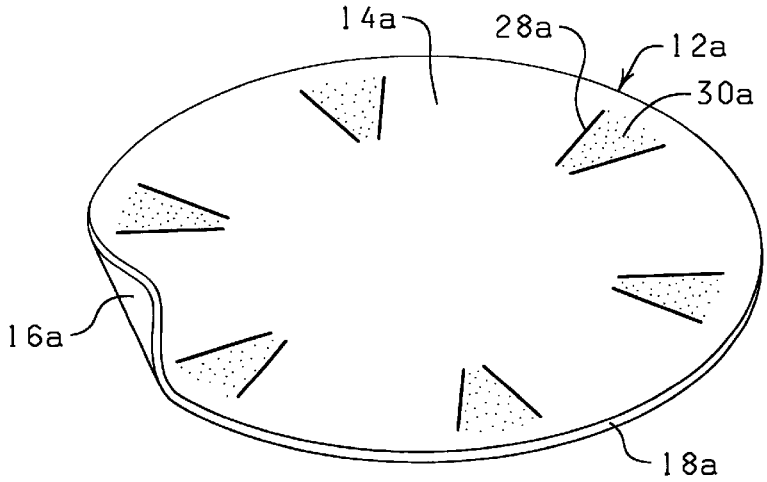
FIG. 6 is a perspective view of a round sheet of material constructed in accordance with the present invention, the round sheet of material having forming indicia thereon and having one corner turned up for illustration purposes only.
Figure 7:
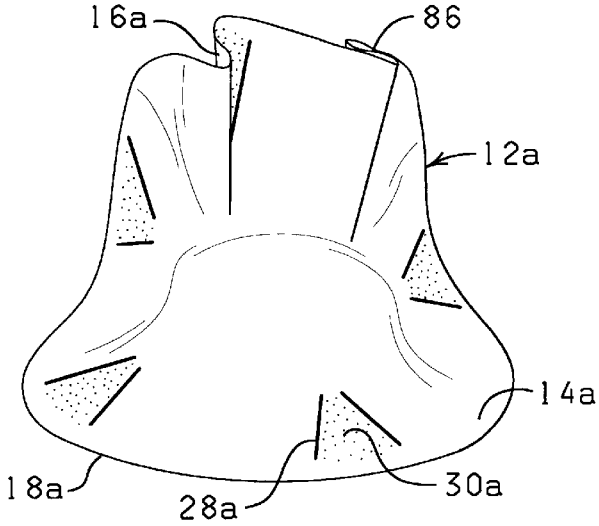
FIG. 7 is a perspective view of the sheet of material of FIG. 6 being partially formed into a decorative cover.

FIGS. 6–9 illustrate another embodiment of the present invention. FIGS. 6 and 7 shows a sheet of material 12*a* which is constructed similar to the sheet of material 12 described in detail before and shown in FIGS. 1–3, except that the sheet of material 12*a* is round, and forming indicia 28*a* are disposed on an upper surface 14*a* of the sheet of material 12*a* which form a different pattern than the forming indicia 28 of the sheet of material 12, i.e., the forming indicia 28*a* define a plurality of flaps rather than a plurality of pleats. The sheet of material 12*a* is also provided with a bonding material 30*a* which cooperates with the forming indicia 28*a* in providing guidance to an operator on the formation of a decorative cover 36*a* from the sheet of material 12*a*.

Figure 8:
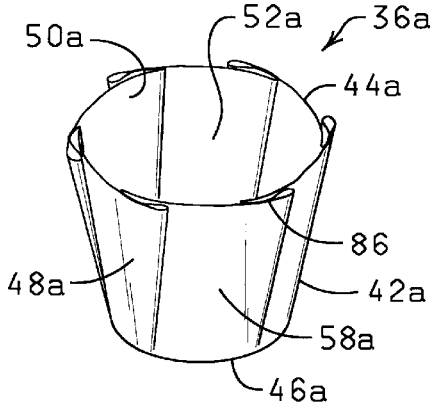
FIG. 8 is a perspective view of a decorative cover formed from the sheet of material of FIG. 6, the decorative cover having a plurality of overlapping flaps.

The sheet of material 12*a* is formed into the decorative cover 36*a* by an operator connecting the sheet of material 12*a* to itself along the pattern of lines and/or creases defining the forming indicia 28*a*, and gathering the sheet of material 12*a* indicated by each of the forming indicia 28*a* into one flap 86 at a time via the connection of the bonding material 30 to itself, as shown in FIGS. 7 and 8. In this manner, when each of the plurality of flaps 86 is formed on the sheet of material 12*a*, the sheet of material 12*a* forms the decorative cover 36*a*, as illustrated in FIG. 8.

The decorative cover 36*a* has a base 42*a* but not a skirt. The base 42*a* of the decorative cover 36*a* is provided with an open upper end 44*a*, a lower end 46*a*, an outer peripheral surface 48*a*, an inner peripheral surface 50*a*, and a retaining space 52*a*.

Each of the plurality of flaps 86 may be formed such that each flap 86 overlaps a portion of the outer peripheral surface 48*a* of the base 42*a* of the decorative cover 36*a*. Alternatively, each of the plurality of flaps 86 may be formed such that each flap 86 overlaps the inner peripheral surface 50*a* of the base 42*a* of the decorative cover 36*a*. Additional bonding material (not shown) may be utilized on the decorative cover 36*a* to hold at least a portion of each flap 86 to either the outer peripheral surface 48*a* or the inner peripheral surface 50*a* of the base 42*a* of the decorative cover 36*a*. For example, a bonding material (not shown) may be applied to a lower surface 16*a* of the sheet of material 12*a* in a position such that upon forming each of the flaps 86, the flap 86 is connected to the lower surface 16*a* of the sheet of material 12*a*, and therefore the outer peripheral surface 48*a* of the base 42*a* of the decorative cover 36*a*, to prevent the flap 86 from protruding from the outer peripheral surface 48*a* of the base 42*a* of the decorative cover 36*a*.

The outer peripheral surface 48*a* of the base 42*a* of the decorative cover 36*a* is provided with a plurality of panels 58*a* which extend from the open upper end 44*a* of the base 42*a* of the decorative cover 36*a* to the lower end 46*a* of the base 42*a* of the decorative cover 36*a*. A decorative pattern may be provided on the lower surface 16*a* of the sheet of material 12*a*, and such pattern may be displayed on the panels 58*a* of the outer peripheral surface 48*a* of the base 42*a* of the decorative cover 36*a* with little or no distortion thereto, and only the portion of the decorative pattern disposed on the portion of the sheet of material 12*a* which forms the flaps 86 of the decorative cover 36*a* being hidden from view.

Figure 9:
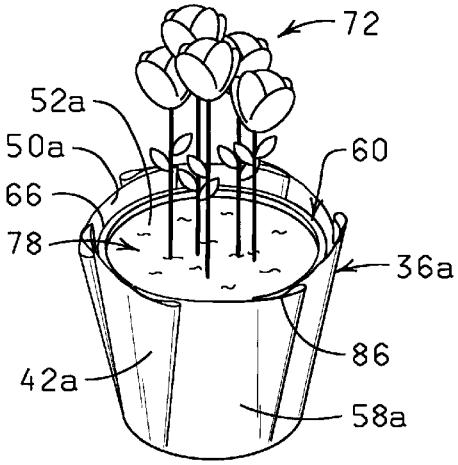
FIG. 9 is a perspective view of the decorative cover of FIG. 8 having a flower pot and floral grouping disposed therein.

Shown in FIG. 9 is the flower pot 60 containing the floral grouping 72 and growing medium 78 (described hereinbefore with reference to FIG. 4) disposed within the retaining space 52*a* of the base 42*a* of the decorative cover 36*a*. The outer peripheral surface 66 of the flower pot 60 is adjacent the inner peripheral surface 50*a* of the base 42*a* of the decorative cover 36*a*, and the flower pot 60 is surrounded and encompassed by the decorative cover 36*a*. However, it will be understood that the flower pot 60 containing the floral grouping 72 and growing medium 78 may be disposed in the decorative cover 36*a* before, during or after its formation, and that disposal of the flower pot 60 containing the floral grouping 72 within the decorative cover 36*a* is shown herein for illustrative purposes only. In addition, it will be understood that the floral grouping 72 and growing medium 78 may be directly disposed in the decorative cover 36*a*.

Figure 10:
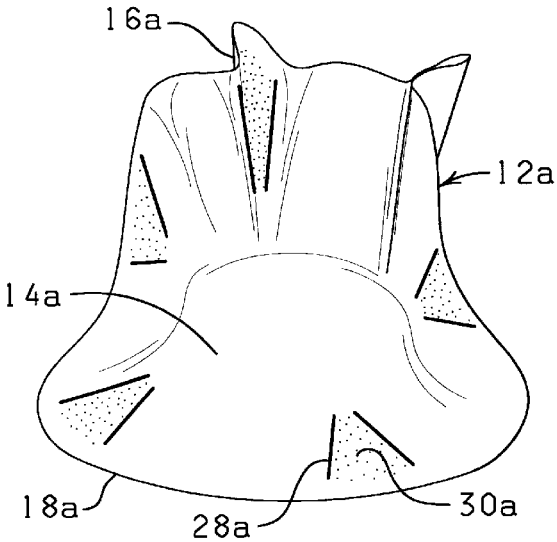
FIG. 10 is a perspective view of the sheet of material of FIG. 6 being partially formed into another embodiment of a decorative cover constructed in accordance with the present invention.
Figure 11:
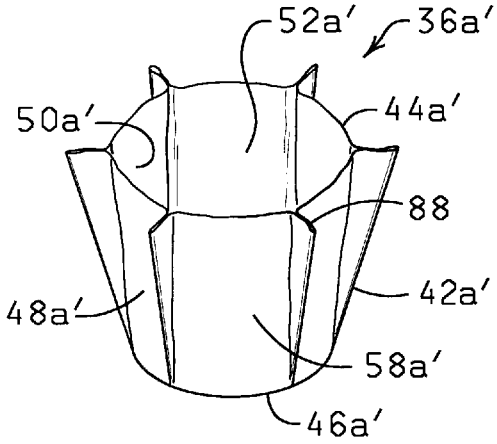
FIG. 11 is a perspective view of a decorative cover formed from the sheet of material of FIG. 6, the decorative cover having a plurality of fins.
Figure 12:
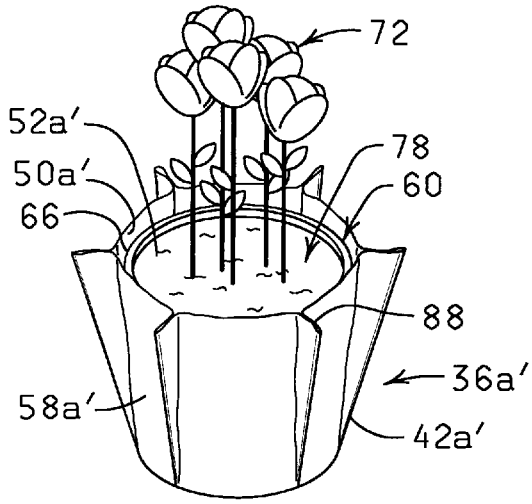
FIG. 12 is a perspective view of the decorative cover of FIG. 11 having a flower pot and floral grouping disposed therein.

Shown in FIGS. 10–12 is another embodiment of the present invention. The sheet of material 12*a* shown in FIG. 6 is formed into a decorative cover 36*a'* which is similar to the decorative cover 36*a* of FIG. 9, except that the decorative cover 36*a'* is provided with a plurality of protruding flaps or fins 88 rather than the plurality of flaps 86 provided on the decorative cover 36*a*.

An operator forms the sheet of material 12*a* into the decorative cover 36*a*' by gathering the sheet of material 12*a* indicated by one of the forming indicia 28*a* together into one fin 88, substantially as shown in FIG. 10. In this manner, when each of the plurality of fins 88 is formed on the sheet of material 12*a*, the fin 88 is held in position via the bonding material 30*a*, and upon forming all of the portions of the sheet of material 12*a* having forming indicia 28*a* thereon into fins 88, the sheet of material 12*a* forms the decorative cover 36*a'*, as illustrated in FIG. 11. It will be understood that the fins 88 can be formed to extend outward, as shown in FIGS. 10–12, or, alternatively, the fins 88 can be formed to extend inwardly, toward a retaining space 52*a'* of a base 42*a'* of the decorative cover 36*a'*.

As shown in FIG. 11, the decorative cover 36*a*' is formed with the base 42*a*′ which is provided with an open upper end 44*a*′, a lower end 46*a*′, an outer peripheral surface 48*a*′, an inner peripheral surface 50*a*′, and the retaining space 52*a*′. The outer peripheral surface 48*a*′ of the base 42*a*′ of the decorative cover 36*a*' is provided with a plurality of panels 58*a*′ which extend from the open upper end 44*a*′ of the base 42*a*' of the decorative cover 36*a*' to the lower end 46*a*′ of the base 42*a*' of the decorative cover 36*a*′. A decorative pattern may be provided on the lower surface 16*a* of the sheet of material 12*a*, and such pattern may be displayed on the panels 58*a*′ of the outer peripheral surface 48*a*′ of the base 42*a*′ of the decorative cover 36*a*' with little or no distortion thereto, and only the portion of the decorative pattern disposed on the portion of the sheet of material 12*a* which forms the fins 88 of the decorative cover 36*a*' being hidden from view.

Shown in FIG. 12 is the flower pot 60 having the floral grouping 72 and growing medium 78 disposed therein as described herein before with reference to FIG. 4 disposed within the retaining space 52*a*′ of the base 42*a*′ of the decorative cover 36*a*'. The outer peripheral surface 66 of the flower pot 60 is substantially adjacent the inner peripheral surface 50*a*′ of the base 42*a*' of the decorative cover 36*a*′, and the flower pot 60 is surrounded and encompassed by the decorative cover 36*a*′. However, it will be understood that the flower pot 60 alone, the floral grouping 72 alone, the growing medium 78 alone, or any combination thereof may be disposed in the decorative cover 36*a*' before, during or after formation thereof, and combinations of the flower pot 60, the floral grouping 72 and growing medium 78 may be disposed in the decorative cover 36*a*' at different times before, during or after formation of the decorative cover 36*a*′. That is, the flower pot 60 may be disposed on the sheet of material 12*a* prior to formation of the decorative cover 36*a*′, and the growing medium 78 and/or floral grouping 72 disposed in the flower pot 60 following formation of the decorative cover 36*a*′.

Description of FIGS. 13–16

Figure 13:
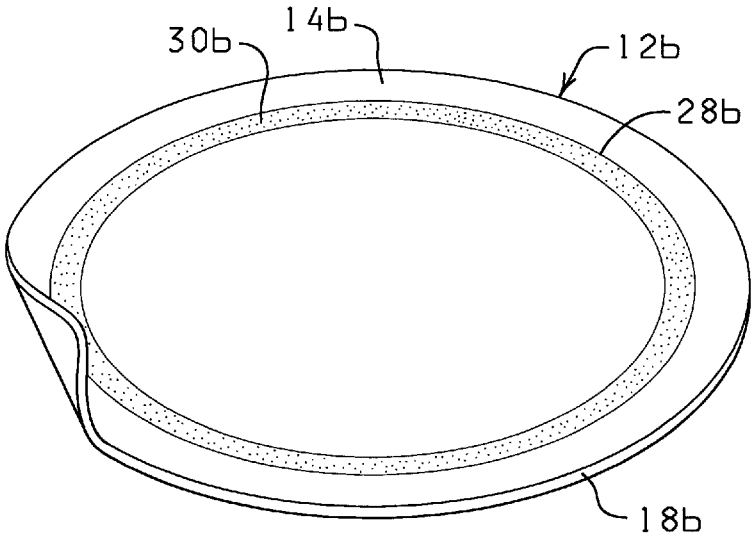
FIG. 13 is a perspective view of a round sheet of material constructed in accordance with the present invention, the round sheet of material having forming indicia thereon and having one corner turned up for illustration purposes only.
Figure 14:
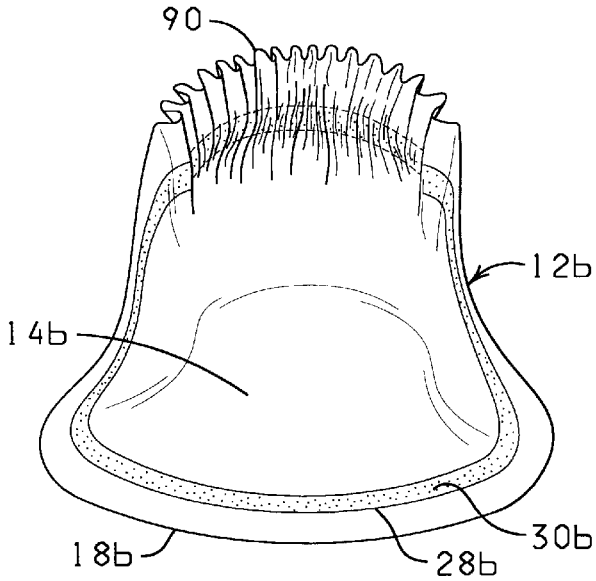
FIG. 14 is a perspective view of the sheet of material of FIG. 13 being partially formed into a decorative cover.
Figure 15:
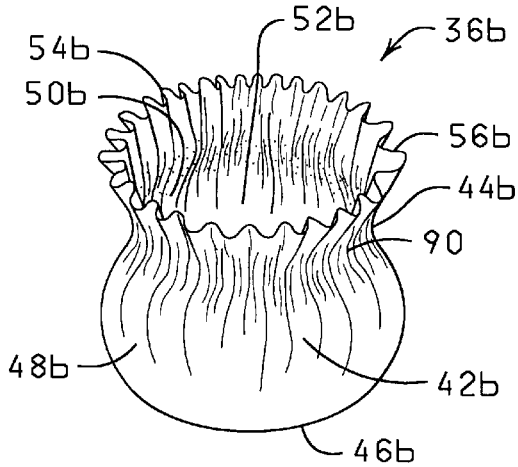
FIG. 15 is a perspective view of a decorative cover formed from the sheet of material of FIG. 13, the decorative cover having a crimped portion formed about an outer peripheral surface of the decorative cover, the decorative cover billowing outward from the crimped portion.
Figure 16:
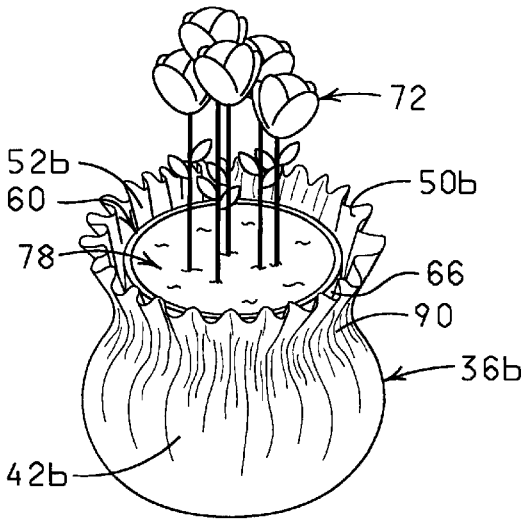
FIG. 16 is a perspective view of the decorative cover of FIG. 15 having a flower pot containing the floral grouping disposed therein.

FIGS. 13–16 illustrate another embodiment of the present invention. FIGS. 13 and 14 show a sheet of material 12*b* which is constructed similar to the sheet of material 12 described in detail before and shown in FIGS. 1–3, except that the sheet of material 12*b* is round and is provided with forming indicia 28*b* and bonding material 30*b* disposed on an upper surface 14*b* thereof in the shape of a circle or a ring. By disposing the forming indicia 28*b* and bonding material 30*b* on the sheet of material 12*b* in such a manner, the sheet of material 12*b* may be formed into a decorative cover 36*b* (FIG. 15) having a billowing shape. This shape is formed when the circle of forming indicia 28*b* is gathered and crimped together to provide a plurality of gathered or crimped portions 90, and the plurality of crimped or gathered portions 90 are held together via the bonding material 30*b*, thereby forming the decorative cover 36*b*. It will be appreciated, however, that the gathered or crimped portions 90 may assume different patterns, and the pattern depicted in FIGS. 14–16 is for illustrative purposes only.

In a method of forming the decorative cover 36*b*, an operator gathers, or crimps, a portion of the sheet of material 12*b* along the circle of forming indicia 28*b* and creates the gathered or crimped portion 90, substantially as shown in FIG. 14. The gathered or crimped portion 90 is then held together via the bonding material 30*b*. This operation is continued about the sheet of material 12*b* until all areas along the circle of forming indicia 28*b* have been gathered and crimped into the plurality of gathered or crimped portions 90 as illustrated in FIG. 15. In this manner, the sheet of material 12*b* is completely formed into the decorative cover 36*b* without the use of a mold.

The decorative cover 36*b* is provided with a base 42*b* and a skirt 54*b*. The base 42*b* has an open upper end 44*b*, a lower end 46*b*, an outer peripheral surface 48*b*, an inner peripheral surface 50*b*, and a retaining space 52*b*. The skirt 54*b* is connected to the open upper end 44*b* of the base 42*b* of the decorative cover 36*b* and has an outer edge 56*b* which has an undulating or sinusoidal pattern.

Following formation of the decorative cover 36*b*, the flower pot 60 containing the floral grouping 72 and/or the growing medium 78 (as described hereinbefore with reference to FIG. 4) are disposed within the retaining space 52*b* of the base 42*b* of the decorative cover 36*b*, substantially as shown in FIG. 16. The outer peripheral surface 66 of the flower pot 60 is substantially adjacent the inner peripheral surface 50*b* of the base 42*b* of the decorative cover 36*b*, and the flower pot 60 is surrounded and encompassed by the decorative cover 36*b*. The skirt 54*b* of the decorative cover 36*b* surrounds a lower portion of the floral grouping 72 disposed in the flower pot 60.

While the flower pot 60 containing the floral grouping 72 and growing medium 78 is depicted herein as being disposed in the decorative cover 36*b* after such has been formed from the sheet of material 12*b*, it will be understood that the flower pot 60 containing the floral grouping 72 and growing medium 78 may be disposed in the decorative cover 36*b* before, during or after formation thereof. Further, it will be understood that the flower pot 60 alone, the floral grouping 72 alone, the growing medium 78 alone, and any combination thereof may be disposed in the decorative cover 36*b* before, during or after formation thereof, and the flower pot 60, floral grouping 72 and/or growing medium 78 may be disposed in the decorative cover 36*b* at different times before, during or after formation thereof.

In an alternative method (similar to the method for forming the sheet of material 12 into the decorative cover 36 as described herein before with reference to FIG. 4), the flower pot 60 may be placed on the sheet of material 12*b* at any time before or during the formation of the decorative cover 36*b*; this is true for all of the decorative covers 36, 36*a*, 36*a*' and 36*b* shown herein and described in detail. The flower pot 60 is not, however, used for a mold for formation of the decorative cover 36*b*. In addition, the decorative cover 36*b* may be formed such that the sheet of material 12*b* is gathered or crimped into the plurality of gathered or crimped portions 90 to form the decorative cover 36*b* at any level around the outer peripheral surface 66 of the flower pot 60 and/or above the outer peripheral surface 66 of the flower pot 60, such as above the open upper end 62 of a flower pot 60. In this manner, the upper end 44*b* of the base 42*b* of the decorative cover 36*b*, after formation, will be of a smaller diameter than the widest diameter of the flower pot 60.

In this embodiment, it will be understood that the sheet of material 12*b*, when crimped and/or gathered via the forming indicia 28*b* and held in position via the bonding material 30*b*, forms irregular, sinusoidal-type loose folds which are unconnected and which "billow" outward. This loose gathering permits a pattern on the sheet of material 12*b* to be substantially illustrated without too much of the pattern being removed from view via large hidden folds.

With regard to all embodiments (FIGS. 1–16) illustrated and described herein, it will be understood that there is an excess of material in the sheets of material constructed in accordance with the present invention which can be formed into various patterns. This excess of material in the sheets of material constructed in accordance with the present invention can be folded or gathered in specific patterns to form decorative covers as shown schematically in FIGS. 1–16, and such figures are not intended as a limitation on the types of folding or gathered patterns, as other patterns for the excess material which can be created by a person of ordinary skill in the art will logically follow. Further, although an adhesive or cohesive bonding material is described as being utilized in FIGS. 1–16, it will be understood that other types of bonding material described herein may be utilized in alternative embodiments. Further, it will be understood that it is not necessary during the formation of the decorative cover to connect any portion of the decorative cover to a flower pot or a plant in a growing medium before, during or after the formation of the decorative cover. While such a connection is an option, it is not required, as illustrated and described herein before.

Further, it will also be appreciated that the excess of the sheet of material may form one or more gussets (not shown). These gussets may be disposed in the base of the decorative cover at any location, on the lower end of the decorative cover, on a skirt of the decorative cover, and any combination thereof. The sheet of material may be provided with additional forming indicia which instruct an operator on the formation of such gussets.

A non-shape sustaining material will frequently be used as the sheet of material from which the decorative covers are constructed in all embodiments shown herein and described in detail. Further, when the sheet of material is formed of a plurality of layers, at least one layer of the sheet of material will frequently be made from a material which is substantially water impermeable. It will also be understood that once the decorative cover is formed, it is substantially self-supporting. The flexibility of the decorative cover permits the decorative cover to be flattened and unflattened without any substantial loss of shape of the decorative cover when unflattened and returned to the formed shape after flattening.

Changes may be made in the embodiments of the invention described herein, or in parts or elements of the embodiments described herein, or in the sequence of steps of the methods described herein, without departing from the spirit and/or scope of the invention as defined in the following claims.

What is claimed is:

1. A decorative cover for a flower pot or potted plant, the decorative cover comprising:

a base capable of being flattened and unflattened, the base having an open upper end, a lower end, an inner peripheral surface, a retaining space for receiving at least a portion of the flower pot or potted plant, and a plurality of gathered portions spatially disposed along a portion of the inner peripheral surface of the base whereby an outer peripheral surface of the base is provided with a plurality of panels extending from the open upper end of the base to the lower end thereof, the gathered portions selected from the group consisting of pleats, folds, fins, flaps, crimps and combinations thereof, the decorative cover formed from a sheet of material having an upper surface, a lower surface and an outer periphery, the sheet of material having forming indicia thereon and a bonding material disposed thereon substantially adjacent the forming indicia, the forming indicia being selected from the group consisting of score lines, printed indicia, embossed indicia, creases, textures, a lack of pattern that is present on other portions of the sheet of material, and combinations thereof, the sheet of material formed into the decorative cover by gathering portions of the sheet of material along the forming indicia to provide the plurality of gathered portions and bondingly connecting each of the plurality of gathered portions of the decorative cover with the bonding material, thereby forming the sheet of material into the decorative cover without use of a mold, such as a flower pot or potted plant.

2. The decorative cover of claim 1 wherein the sheet of material is selected from the group consisting of paper, foil, polymeric film, fabric, burlap and combinations and laminates thereof.

3. The decorative cover of claim 1 wherein the sheet of material has a thickness in a range of from about 0.1 mil to about 30 mil.

4. A decorative cover for a flower pot or potted plant, the decorative cover comprising:

a base capable of being flattened and unflattened, the base having an open upper end, a lower end, an inner peripheral surface, a retaining space for receiving at least a portion of the flower pot or potted plant, and a plurality of crimped portions disposed along a portion of the inner peripheral surface and an outer peripheral surface of the base whereby the outer peripheral surface of the base is provided with a plurality of unconnected folds, the decorative cover formed from a sheet of material having an upper surface, a lower surface and an outer periphery, the sheet of material having forming indicia thereon and a bonding material disposed thereon substantially adjacent the forming indicia, the forming indicia being selected from the group consisting of score lines, printed indicia, embossed indicia, creases, textures, a lack of pattern that is present on other portions of the sheet of material, and combinations thereof, the sheet of material formed into the decorative cover by gathering portions of the sheet of material along the forming indicia to provide the plurality of crimped portions and bondingly connecting each of the plurality of crimped portions of the decorative cover with the bonding material, thereby forming the sheet of material into the decorative cover without use of a mold, such as a flower pot or potted plant.

5. The decorative cover of claim 4 wherein the sheet of material is selected from the group of materials consisting of paper, foil, polymeric film, fabric, burlap and combinations or laminates thereof.

6. The decorative cover of claim 4 wherein the sheet of material has a thickness in a range of from about 0.1 mil to about 30 mil.

7. A method of forming a decorative cover for a flower pot or potted plant, comprising the steps of:

providing a sheet of material having an upper surface, a lower surface and an outer periphery, the sheet of material having forming indicia thereon, the sheet of material having a bonding material disposed thereon substantially adjacent the forming indicia, the forming indicia being selected from the group consisting of score lines, printed indicia, embossed indicia, creases, textures, a lack of pattern that is present on other portions of the sheet of material, and combinations thereof;

providing a flower pot or potted plant having an outer peripheral surface;

gathering portions of the sheet of material along the forming indicia to form a plurality of gathered portions and simultaneously bondingly connecting each of the plurality of gathered portions, thereby forming a decorative cover comprising a substantially shape sustaining base having an open upper end, a lower end, an inner peripheral surface, and a retaining space for receiving at least a portion of the flower pot or potted plant, the plurality of gathered portions spatially disposed along a portion of the inner peripheral surface of the substantially shape sustaining base wherein the gathered portions are selected from the group consisting of pleats, folds, fins, flaps, crimps and combinations thereof, an outer peripheral surface of the substantially shape sustaining base having a plurality of panels extending from the open upper end of the substantially shape sustaining base to the lower end thereof; and disposing the flower pot or potted plant in the retaining space of the substantially shape sustaining base after the decorative cover is formed, the outer peripheral surface of the flower pot or potted plant being substantially surrounded and encompassed by the decorative cover.

8. The method of claim 7 wherein, in the step of providing a sheet of material, the sheet of material is further defined as being selected from the group consisting of paper, foil, polymeric film, fabric, burlap and combinations or laminates thereof.

9. The method of claim 7 wherein, in the step of providing a sheet of material, the sheet of material is further defined as having a thickness in a range of from about 0.1 mil to about 30 mil.

10. A method of forming a decorative cover for a flower pot or potted plant, comprising the steps of:

providing a sheet of material having an upper surface, a lower surface and an outer periphery, the sheet of material having forming indicia thereon, the sheet of material having a bonding material disposed thereon substantially adjacent the forming indicia, the forming indicia being selected from the group consisting of score lines, printed indicia, embossed indicia, creases, textures, a lack of pattern that is present on other portions of the sheet of material, and combinations thereof;

providing a flower pot or potted plant having an outer peripheral surface;

gathering portions of the sheet of material along the forming indicia to form a plurality of crimped portions and simultaneously bondingly connecting each of the plurality of crimped portions, thereby forming a decorative cover comprising a substantially shape sustaining base having an open upper end, a lower end, an outer peripheral surface, an inner peripheral surface, and a retaining space for receiving at least a portion of the flower pot or potted plant, the plurality of crimped portions disposed along a portion of the inner peripheral surface and the outer peripheral surface of the substantially shape sustaining base; and disposing the flower pot or potted plant in the retaining space of the substantially shape sustaining base after the decorative cover is formed, the outer peripheral surface of the flower pot or potted plant being substantially surrounded and encompassed by the decorative cover.

11. The method of claim 10 wherein, in the step of providing a sheet of material, the sheet of material is further defined as being selected from the group consisting of paper, foil, polymeric film, fabric, burlap and combinations or laminates thereof.

12. The method of claim 10 wherein in the step of providing a sheet of material, the sheet of material is further defined as having a thickness in a range of from about 0.1 mil to about 30 mil.

13. A decorative cover for a flower pot or potted plant, the decorative cover comprising:

a base capable of being flattened and unflattened, the base having an open upper end, a lower end, an inner peripheral surface, a retaining space for receiving at least a portion of the flower pot or potted plant, and a plurality of gathered portions spatially disposed along a portion of the inner peripheral surface of the base whereby an outer peripheral surface of the base is provided with a plurality of panels extending from the open upper end of the base to the lower end thereof, the gathered portions selected from the group consisting of pleats, folds, fins, flaps, crimps and combinations thereof, the decorative cover formed from a sheet of material having an upper surface, a lower surface and an outer periphery, the sheet of material having forming indicia thereon, the forming indicia being selected from the group consisting of score lines, printed indicia, embossed indicia, creases, textures, a lack of pattern that is present on other portions of the sheet of material, and combinations thereof, the sheet of material formed into the decorative cover by gathering portions of the sheet of material along the forming indicia, thereby forming the sheet of material into the decorative cover without use of a mold, such as a flower pot or potted plant.

14. The decorative cover of claim 13 wherein the sheet of material is selected from the group consisting of paper, foil, polymeric film, fabric, burlap and combinations and laminates thereof.

15. The decorative cover of claim 13 wherein the sheet of material has a thickness in a range of from about 0.1 mil to about 30 mil.

16. A method of forming a decorative cover for a flower pot or potted plant, comprising the steps of:

providing a sheet of material having an upper surface, a lower surface and an outer periphery, the sheet of material having forming indicia thereon, the forming indicia being selected from the group consisting of score lines, printed indicia, embossed indicia, creases, textures, a lack of pattern that is present on other portions of the sheet of material, and combinations thereof;

providing a flower pot or potted plant having an outer peripheral surface;

gathering portions of the sheet of material along the forming indicia to form a plurality of gathered portions, thereby forming a decorative cover comprising a substantially shape sustaining base having an open upper end, a lower end, an inner peripheral surface, and a retaining space for receiving at least a portion of the flower pot or potted plant, the plurality of gathered portions spatially disposed along a portion of the inner peripheral surface of the substantially shape sustaining base wherein the gathered portions are selected from the group consisting of pleats, folds, fins, flaps, crimps and combinations thereof, an outer peripheral surface of the substantially shape sustaining base having a plurality of panels extending from the open upper end of the substantially shape sustaining base to the lower end thereof; and disposing the flower pot or potted plant in the retaining space of the substantially shape sustaining base after the decorative cover is formed, the outer peripheral surface of the flower pot or potted plant being substantially surrounded and encompassed by the decorative cover.

17. The method of claim 16 wherein, in the step of providing a sheet of material, the sheet of material is further defined as being selected from the group consisting of paper, foil, polymeric film, fabric, burlap and combinations or laminates thereof.

18. The method of claim 16 wherein in the step of providing a sheet of material, the sheet of material is further defined as having a thickness in a range of from about 0.1 mil to about 30 mil.

19. A decorative cover for a flower pot or potted plant, the decorative cover comprising:

a substantially shape-sustaining base capable of being flattened and unflattened, the base having an open upper end, a lower end, an inner peripheral surface, a retaining space for receiving at least a portion of the flower pot or potted plant, and a plurality of crimped portions disposed along a portion of the inner peripheral surface and an outer peripheral surface of the base whereby the outer peripheral surface of the base is provided with a plurality of unconnected folds, the decorative cover formed from a sheet of material having an upper surface, a lower surface and an outer periphery, the sheet of material having forming indicia thereon, the forming indicia being selected from the group consisting of score lines, printed indicia, embossed indicia, creases, textures, a lack of pattern that is present on other portions of the sheet of material, and combinations thereof, the sheet of material formed into the decorative cover by gathering portions of the sheet of material along the forming indicia to provide the plurality of crimped portions, thereby forming the sheet of material into the decorative cover without use of a mold, such as a flower pot or potted plant.

20. The decorative cover of claim 19 wherein the sheet of material is selected from the group of materials consisting of paper, foil, polymeric film, fabric, burlap and combinations or laminates thereof.

21. The decorative cover of claim 19 wherein the sheet of material has a thickness in a range of from about 0.1 mil to about 30 mil.

22. A decorative cover for a flower pot or potted plant, the decorative cover comprising:

a base capable of being flattened and unflattened, the base having an open upper end, a lower end, an inner peripheral surface, a retaining space for receiving at least a portion of the flower pot or potted plant, and a plurality of crimped portions disposed along a portion of the inner peripheral surface and an outer peripheral surface of the base whereby the outer peripheral surface of the base is provided with a plurality of unconnected folds, the decorative cover formed from a sheet of material having an upper surface, a lower surface and an outer periphery, the sheet of material having forming indicia thereon, the forming indicia being selected from the group consisting of score lines, printed indicia, embossed indicia, creases, textures, a lack of pattern that is present on other portions of the sheet of material, and combinations thereof, the sheet of material formed into the decorative cover by gathering portions of the sheet of material along the forming indicia to provide the plurality of crimped portions, thereby forming the sheet of material into the decorative cover without use of a mold, such as a flower pot or potted plant.

23. The decorative cover of claim 22 wherein the sheet of material is selected from the group of materials consisting of paper, foil, polymeric film, fabric, burlap and combinations or laminates thereof.

24. The decorative cover of claim 22 wherein the sheet of material has a thickness in a range of from about 0.1 mil to about 30 mil.

* * * * *